United States Patent [19]

Gober

[11] Patent Number: 4,595,076

[45] Date of Patent: Jun. 17, 1986

[54] TREE CLIMBING APPARATUS

[76] Inventor: Benjamin G. Gober, 275 Clifton Dr., Athens, Ga. 30603

[21] Appl. No.: 772,532

[22] Filed: Sep. 4, 1985

[51] Int. Cl.[4] ..... A45F 3/26; A47C 9/10; A63B 27/00

[52] U.S. Cl. ..... 182/136; 182/135; 182/187; 24/269

[58] Field of Search ..... 182/133, 134, 135, 136, 182/9, 187; 24/68 PP, 68 R, 19, 269

[56] References Cited

U.S. PATENT DOCUMENTS

| | | | |
|---|---|---|---|
| 109,213 | 11/1870 | Butler | 24/269 |
| 882,850 | 3/1908 | Troell | 182/187 |
| 2,168,111 | 8/1939 | Barnes | 304/28 |
| 2,375,685 | 5/1945 | Pennington | 304/28 |
| 3,955,645 | 5/1976 | Dye | 182/135 |
| 4,109,761 | 5/1978 | Matlock | 182/92 |
| 4,168,765 | 9/1979 | Ferguson | 182/135 |
| 4,244,445 | 1/1981 | Strode | 182/136 |
| 4,283,816 | 8/1981 | Tanaka | 24/269 |

*Primary Examiner*—Reinaldo P. Machado
*Attorney, Agent, or Firm*—Harvey B. Jacobson

[57] ABSTRACT

Apparatus for use in climbing a tree, for example, in conjunction with a tree stand, comprises a metal strap having one end attached to one corner of a rectangular plate and the other end adjustably attachable to the diagonally opposite corner of the plate after encircling the strap around a tree. The plate has a lever extending across the other diagonal for twisting the plate so as to decrease the horizontal distance between the two strap attachments thereby tightening the strap around the tree and allowing a user to pull him or herself up on the lever. The apparatus is used by alternating upward stepwise movements thereof with upward stepwise movements of the tree stand, the user alternating his or her weight between the two items accordingly.

5 Claims, 5 Drawing Figures

TREE CLIMBING APPARATUS

BACKGROUND OF THE INVENTION

Field of the Invention

This invention relates to apparatus for assisting a user in climbing a tree, telegraph pole, or the like, preferably in conjunction with a tree stand.

SUMMARY OF THE INVENTION

Climbing apparatus in accordance with the invention comprises a plate member having one end of a strap or band secured thereto by a first attachment, a second attachment on the plate for receiving a free end of the strap in adjusted position along the strap with the strap encircling a tree or pole, and a hand lever on the plate for twisting the plate in a manner tightening the strap around the tree or pole by decreasing the horizonal distance between the attachments, the lever providing a handgrip portion at least at one end thereof for the user to pull him or herself up the tree when the strap is tightened, whereafter the strap may be loosened by reverse twisting of the plate, moved up the tree or pole, and retightened, the process being continued so that the user may pull him or herself in stepwise increments up the tree or pole, possibly in conjunction with a tree stand which the user pulls up the tree or pole with the feet when pulling upon the lever and on which the user stands while moving the strap up to a succeeding location.

In one preferred form of the invention, for example, the plate may be rectangular with the attachments located at diagonally opposite corners and the hand lever extending across the opposite diagonal of the plate. The strap may be in the form of a flexible metal band.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
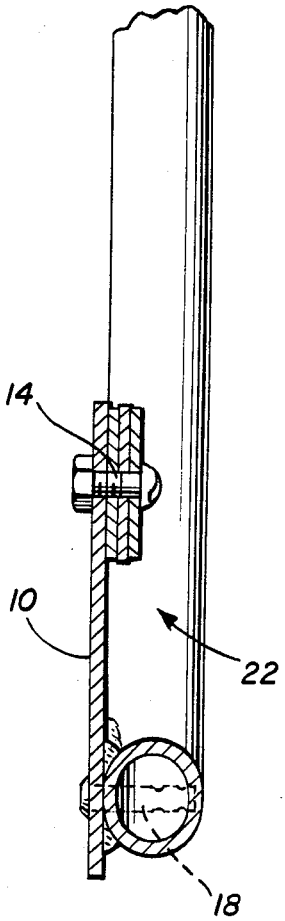
FIG. 4 is a further enlarged view on line 4—4 of FIG. 3.
Figure 3:
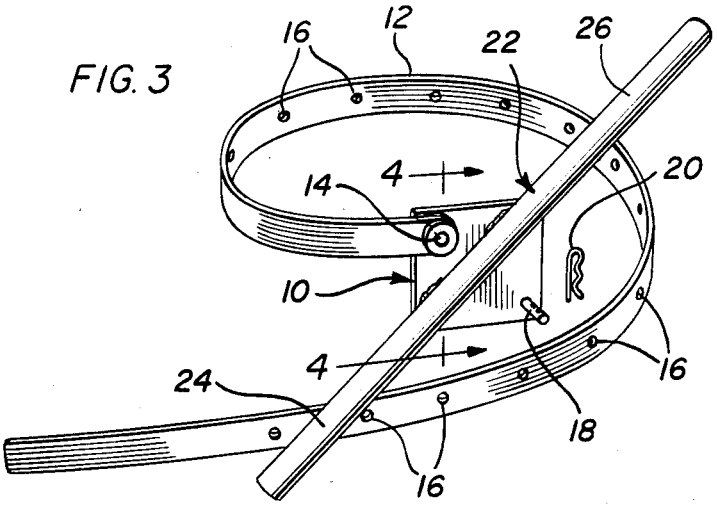
FIG. 3 is an enlarged perspective view of apparatus in accordance with the invention.
Figure 5:
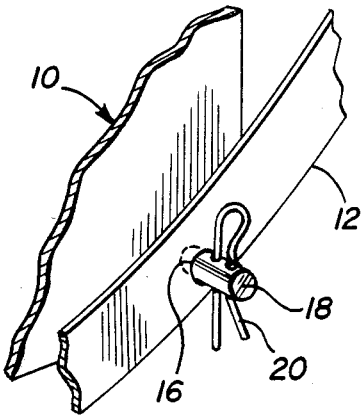
FIG. 5 is a scrap view showing part of the apparatus.

Tree climbing apparatus in accordance with the invention, as shown more particularly in FIGS. 3–5, comprises a rectangular metal plate 10 having one end of a metal or like strap 12 riveted or similarly attached to one corner thereof, as at 14, the strap being formed with a series of holes 16 along its length. The diagonally opposite corner of the plate 10 is provided with a stud 18 for engaging in a selected hole 16, and a cotter pin 20 is provided for securing the strap in place by engaging a throughbore in stud 18 (FIG. 5). An elongate handgripping lever 22 is welded across the opposite diagonal of the plate 10 to provide handgripping portions 24, 26.

Figure 1:
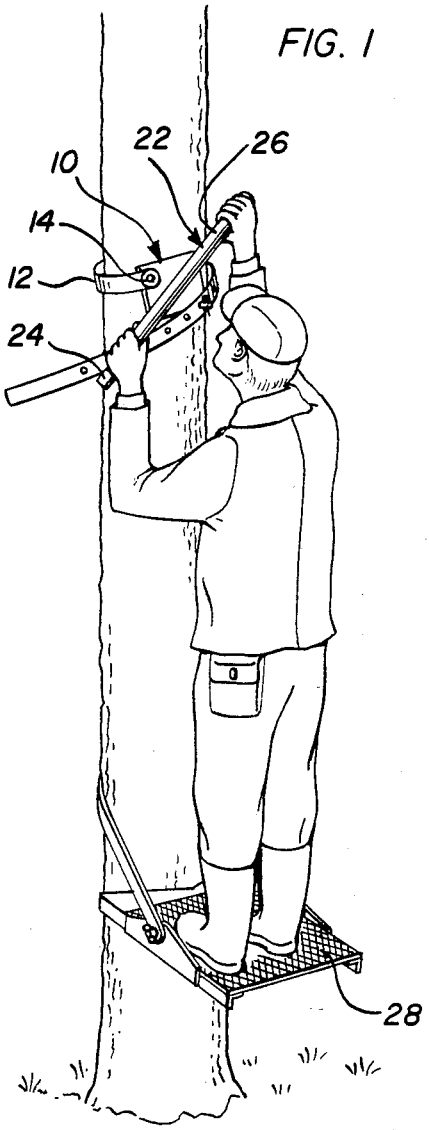
FIGS. 1 and 2 are perspective in-use views of tree climbing apparatus in accordance with the invention showing a sequence of operations used in climbing a tree.
Figure 2:
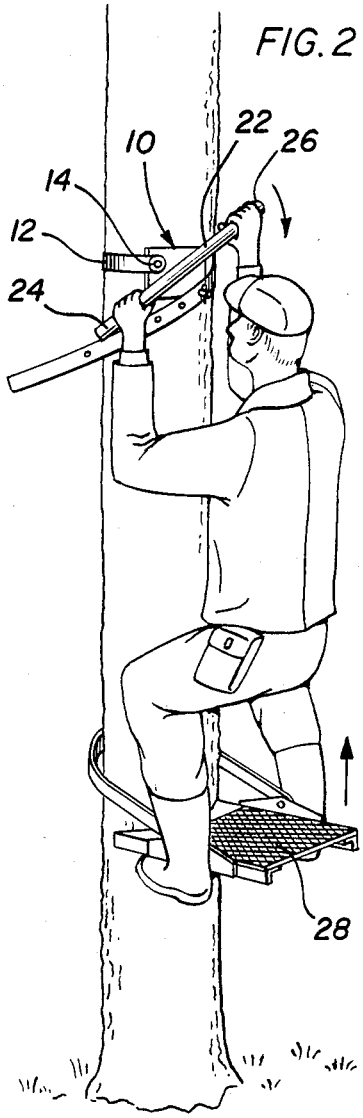

The apparatus may be used for climbing a tree (FIGS. 1 and 2) or pole in conjunction with a known form of tree stand 28. Thus, in use, a user sets the stand, stands on the stand, and with strap 12 released from stud 18 places the strap around the tree at a comfortable distance above the user's head. The user pulls the strap as tightly as possible around the tree, inserts the relevant hole 16 in stud 18, and inserts the cotter pin. Then, the user twists lever 22 in a clockwise direction so as to reduce the horizontal distance between stud 18 and corner 14 of the plate thereby tightening the strap 12 onto the tree. This allows the user to pull himself or herself up the tree using portion 26 of the lever to support his or her weight and simultaneously pulling the tree stand up the tree with the feet. The tree stand is then set in a position higher up the tree, the user again supports him or herself on the tree stand, loosens strap 12 by reverse twisting of lever 22, moves the strap up the tree, retightens the strap as previously and pulls him or herself up the tree by another increment. The process is thus repeated, the user pulling himself or herself up the tree in increments while setting and resetting the tree stand and strap and alternating his or her weight between these two items.

The apparatus according to the invention may be used without the tree stand if, for example, the climber has cleated boots or can otherwise grip the tree with the feet.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Climbing apparatus comprising a plate member having one end of a strap secured thereto by a first attachment, a second attachment on the plate member for retaining a free end portion of the strap in adjusted position along the strap with the strap encircling a tree, pole, or the like, and a hand lever on the plate member for twisting the plate member in a manner tightening the strap around the tree, pole, or the like, by decreasing the horizontal distance between the attachments, the lever providing means for a user to pull up on when the strap is tightened around the tree.

2. The invention of claim 1 wherein the plate member is rectangular, the attachments being located at diagonally opposite corners of the plate member, the hand lever extending across the opposite diagonal of the plate member and extending from at least one corner of the plate member.

3. The invention of claim 1 wherein the second attachment comprises a stud projecting from the plate member for engaging in a selected one of a longitudinal series of holes formed in the strap, and a cotter pin for retaining the strap on the stud.

4. The invention of claim 2 wherein the hand lever extends from both opposite corners of the plate member to provide opposed hand grip portions.

5. The invention of claim 1 in combination with a tree stand for use in climbing the tree, pole, or the like, by alternating upward stepwise movements of the apparatus and stand up the tree, with the user alternating his or her weight as between the apparatus and the tree stand.

* * * * *